US011619216B2

(12) United States Patent
Lee et al.

(10) Patent No.: US 11,619,216 B2
(45) Date of Patent: Apr. 4, 2023

(54) COMPRESSOR

(71) Applicant: LG Electronics Inc., Seoul (KR)

(72) Inventors: Jongwoo Lee, Seoul (KR); Hangjun Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 17/183,920

(22) Filed: Feb. 24, 2021

(65) Prior Publication Data

US 2021/0277886 A1 Sep. 9, 2021

(30) Foreign Application Priority Data

Mar. 6, 2020 (KR) ..... 10-2020-0028406

(51) Int. Cl.

| | |
|---|---|
| ***F04B 39/00*** | (2006.01) |
| ***F04B 53/16*** | (2006.01) |
| ***F04B 53/14*** | (2006.01) |
| ***F04B 53/00*** | (2006.01) |

(52) U.S. Cl.

CPC ..... *F04B 39/0044* (2013.01); *F04B 53/003* (2013.01); *F04B 53/14* (2013.01); *F04B 53/16* (2013.01)

(58) Field of Classification Search

CPC .. F04B 35/045; F04B 39/0044; F04B 39/121; F04B 39/127; F04B 39/14; F04B 53/003; F04B 53/14; F04B 53/16; F16F 15/02–022; F16F 15/04; F16F 15/046–085

See application file for complete search history.

(56) References Cited

U.S. PATENT DOCUMENTS

| | | | | |
|---|---|---|---|---|
| 4,416,594 | A * | 11/1983 | Ichikawa | F04B 35/045 417/372 |
| 5,772,410 | A * | 6/1998 | Chang | F04B 35/045 417/372 |
| 6,832,899 | B2 * | 12/2004 | Puff | F04B 39/127 417/363 |
| 2016/0017877 | A1 * | 1/2016 | Ki | F04B 39/127 417/437 |
| 2017/0321674 | A1 * | 11/2017 | Ha | F04B 35/045 |
| 2019/0032649 | A1 * | 1/2019 | Roh | F04B 39/123 |
| 2019/0271301 | A1 * | 9/2019 | Steen | F04B 39/127 |
| 2020/0018302 | A1 * | 1/2020 | Kim | F04B 19/04 |

FOREIGN PATENT DOCUMENTS

| | | |
|---|---|---|
| CN | 109322811 | 2/2019 |
| CN | 109958600 | 7/2019 |
| CN | 110714896 | 1/2020 |
| JP | 2005106034 | 4/2005 |
| KR | 1020160003397 | 1/2016 |
| KR | 10-2017-0086841 | 7/2017 |
| KR | 20190032885 | 3/2019 |

OTHER PUBLICATIONS

KR Office Action in Korean Appln. No. 10-2020-0028496, dated Jan. 20, 2021, 11 pages (with English translation).

Office Action in Chinese Appln. No. 202110198689.3, dated Jun. 20, 2022, 13 pages (with English translation).

* cited by examiner

*Primary Examiner* — Alexander B Comley

(74) *Attorney, Agent, or Firm* — Fish & Richardson P.C.

(57) ABSTRACT

Disclosed is a compressor including a vibration attenuating member that fixes a driving assembly to be spaced apart from an inner circumferential face of a shell and reduces vibration or noise generated in the driving assembly.

19 Claims, 8 Drawing Sheets

COMPRESSOR

CROSS-REFERENCE TO RELATED APPLICATION

This application claims the benefit of Korean Patent Application No. 10-2020-0028406, filed on Mar. 6, 2020, which is hereby incorporated by reference as if fully set forth herein.

TECHNICAL FIELD

The present disclosure relates to a compressor. More specifically, the present disclosure relates to a compressor including a vibration attenuating member that connects a shell that forms an exterior appearance of the compressor with a driving assembly that compresses and discharges refrigerant to attenuate vibrations generated from the driving assembly.

BACKGROUND

In general, a compressor, which is an apparatus applied to a freezing cycle such as a refrigerator or an air conditioner, compresses refrigerant to provide work necessary to generate heat exchange in the freezing cycle.

When classifying the compressors based on a scheme of compressing the refrigerant, the compressors may be classified into a reciprocating compressor that allows a compression space in which the refrigerant is sucked and discharged to be defined between a piston and a cylinder, so that the piston compresses the refrigerant while making a linear reciprocating motion inside the cylinder, a rotary compressor that allows the compression space in which the refrigerant is sucked and discharged to be defined between an eccentrically rotating roller and the cylinder, so that the roller compresses the refrigerant while rotating eccentrically along an inner wall of the cylinder, and a scroll compressor in which an orbiting scroll is configured to orbit in a state of being engaged to a fixed scroll fixed in an inner space of a casing, so that a compression chamber is formed between a fixed wrap of the fixed scroll and an orbiting wrap of the orbiting scroll.

Recently, among the reciprocating compressors, especially linear compressors that allow the piston to be directly connected to a driving motor that is linearly reciprocating to improve a compression efficiency without loss resulted from power transmission, and thus, have a relatively simple structure are being developed a lot.

In a case of the linear compressor, inside a shell that forms an exterior appearance of the compressor but seals an interior thereof, the piston is configured to suck, then compress, and then discharge the refrigerant while linearly reciprocating inside the cylinder by a linear motor.

In general, because the compressed refrigerant is discharged to the outside of the compressor at high temperature and high pressure, a lot of vibration and noise are caused inside the compressor. In this regard, Korean Patent Application Publication No. 10-2017-0086841 (hereinafter, abbreviated as prior art literature) discloses a configuration for reducing the vibration and the noise generated from the linear compressor.

Specifically, the prior art literature discloses a configuration including a shell, a cylinder disposed inside the shell to define a compression space of refrigerant therein, a frame fixing the cylinder to the shell, a piston capable of reciprocating in an axial direction inside the cylinder, an outlet valve disposed in front of the cylinder and selectively discharging the refrigerant compressed in the compression space of the refrigerant, an discharge cover coupled to the frame and having therein a discharge space of the refrigerant discharged through the outlet valve, a valve spring supporting the outlet valve and exerting an elastic force in the axial direction, and a valve support coupled to the valve spring and supported by the frame to transmit vibration generated from the outlet valve to the frame, wherein the configuration transmits vibration and noise generated in the process in which the refrigerant is compressed and discharged to a frame having a larger mass to reduce vibration or noise transmitted to the shell.

However, according to the prior art literature, the vibration generated at a refrigerant discharge side (the outlet valve) is transmitted to the larger mass (the frame in the prior art literature) and dissipated, so that it is difficult to reduce a total amount of the vibration or the noise generated. Further, it is difficult to efficiently reduce the vibration or the noise generated by the refrigerant discharged to the outside of the compressor by flowing through the discharge cover after passing through the outlet valve.

Related prior art literature: Patent Literature: Korean Patent Application Publication No. 10-2017-0086841

SUMMARY

One embodiment of the present disclosure has a purpose to reduce vibration or noise generated by a compressor.

One embodiment of the present disclosure has a purpose to prevent temporary bias of a driving assembly that is fixed inside a shell.

One embodiment of the present disclosure has a purpose to reduce vibration or noise caused by refrigerant discharged out of a compressor by passing through a valve spring.

One embodiment of the present disclosure has a purpose to attenuate or dissipate vibration or noise generated in a driving assembly in a process of transmitting the vibration or the noise to a shell.

One embodiment of the present disclosure has a purpose to reduce an amount of vibration or noise generated in a driving assembly.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

One embodiment of the present disclosure may provide a support structure for supporting a driving assembly in a self-weight direction and a lateral direction to achieve the above purposes.

The support structure may be integrally formed and may include a spring wire having one or more diameters.

An isolating member, such as rubber or plastic, capable of isolating vibration may be double-injected to be joined to the support structure.

In one aspect of the present disclosure, a compressor includes a shell for forming an exterior appearance of the compressor, a driving assembly fixedly disposed inside the shell and spaced apart from an inner circumferential face of the shell, wherein the driving assembly compresses and discharges refrigerant, vibration occurs therein, and a vibration attenuating member for connecting the driving assembly and the shell with each other, and attenuating the vibration of the driving assembly, wherein the vibration attenuating member includes a support portion in contact with the driving assembly to receive the vibration generated in the driving assembly, and an attenuating portion extended from the support portion and coupled to the shell, wherein the attenuating portion is constructed to attenuate the vibration transmitted from the driving assembly to the shell, wherein the attenuating portion is constructed to exert a force of pulling the support portion toward the shell.

In one implementation, the attenuating portion may include an extension extending from the support portion, a coupling portion in contact with the shell and coupled to the shell, and a coil connecting the extension and the coupling portion with each other and having at least a turn to attenuate the vibration.

In one implementation, a position of the extension with respect to the driving assembly may be variable.

In one implementation, the coil may be spaced from the shell or the driving assembly.

In one implementation, the driving assembly may include a compression assembly including a cylinder and a piston to compress the refrigerant, and an discharge cover for discharging the refrigerant compressed in the compression assembly, and the support portion may surround a portion of the discharge cover.

In one implementation, the discharge cover may include a contact portion in contact with the support portion and forming a portion of a circumference of the discharge cover, and a non-contact portion not in contact with the support portion and forming the remaining portion of the circumference of the discharge cover, and the contact portion may be larger than the non-contact portion.

In one implementation, the attenuating portion may further include a first attenuating portion extending from one end of the support portion, and a second attenuating portion extending from the other end of the support portion.

In one implementation, the support portion may extend from said one end of the support portion to the other end of the support portion, and the support portion may have a portion extending in a manner away both of the first attenuating portion and the second attenuating portion. Alternatively, the support portion may connect said one end of the support portion and the other end of the support portion with each other, and protrude in a direction away from the first attenuating portion and the second attenuating portion to surround the contact portion.

In one implementation, a multiple of turns of the coil may be arranged along an extending direction of the attenuating portion to apply an elastic force to the shell and the driving assembly.

In one implementation, the shell may have a catching hole defined therein such that the coupling portion is fixedly inserted into the catching hole, and the coupling portion may be coupled to the catching hole while in contact with an outer circumferential face of the shell.

In one implementation, the coil may have a first length along the extending direction of the attenuating portion before being inserted into the catching hole, and have a second length different from the first length along the extending direction of the attenuating portion after being inserted into the catching hole. The first length may be smaller than the second length.

In one implementation, the compressor may further include a bracket disposed between the driving assembly and the inner circumferential face of the shell to support the driving assembly and the shell such that the driving assembly is spaced apart from the inner circumferential face of the shell.

In one implementation, the vibration attenuating member may further include an attenuating member disposed between the coupling portion and the catching hole to attenuate the vibration.

In one implementation, the extension, the coupling portion, and the coil may be integrally formed.

Effects of the present disclosure are as follows but are limited thereto.

According to the implementations of the present disclosure, the vibration or the noise generated by the compressor may be reduced.

According to the implementations of the present disclosure, the temporary bias of the driving assembly inside the shell may be prevented.

According to the implementations of the present disclosure, the vibration or the noise caused by the refrigerant in the process of being discharged out of the compressor after passing through the valve spring.

According to the implementations of the present disclosure, the vibration or the noise generated in the driving assembly may be reduced and transmitted to the shell.

According to the implementations of the present disclosure, the amount of the vibration or the noise generated in the driving assembly may be reduced.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
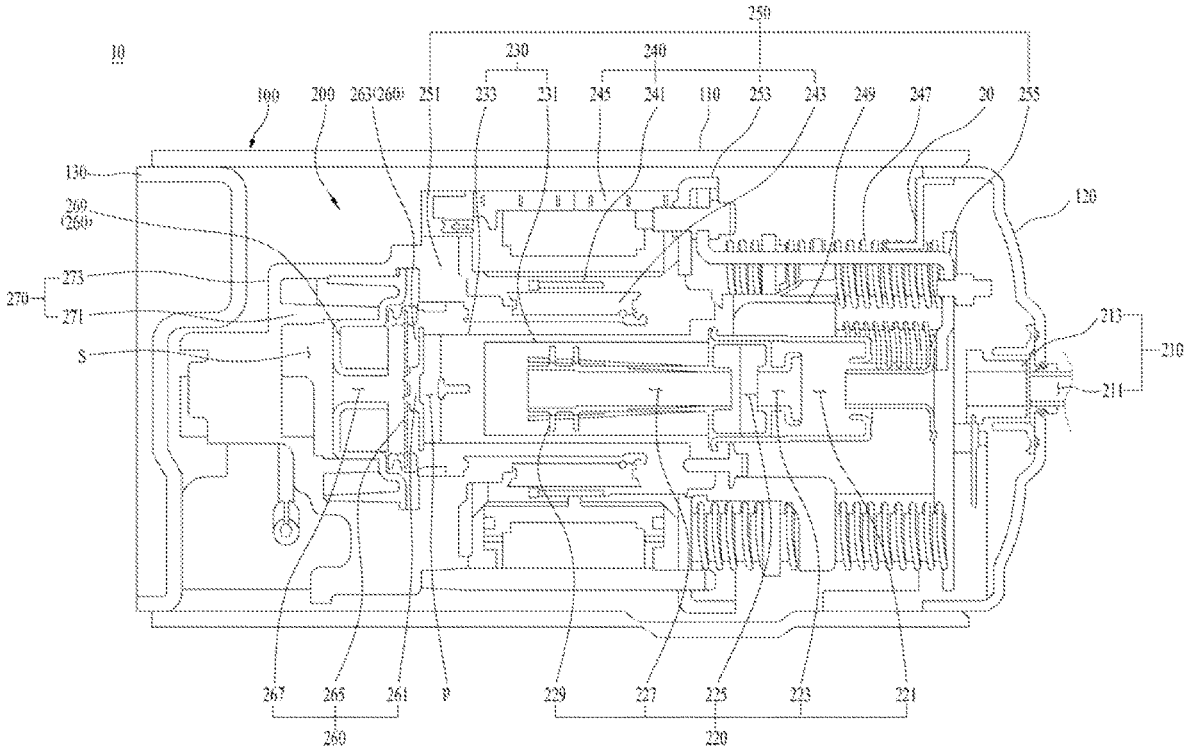
FIG. 1 is a view showing a compressor.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the present disclosure to the specific embodiments as described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or greater of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a compressor 10 will be described with reference to FIG. 1.

FIG. 1 is a diagram illustrating an internal configuration of the compressor 10.

The compressor 10 includes a shell 100 that forms an exterior appearance of the compressor 10 and a driving assembly 200 that compresses refrigerant inside the shell 100 and discharges the refrigerant from the shell 100.

The shell 100 may include a main shell 110 disposed to surround at least a portion of the driving assembly 200, and a first shell cover 120 and a second shell cover 130 respectively coupled to both ends of the main shell 110 to seal an interior of the shell 100.

The main shell 110 may be formed in a shape of a hollow cylinder having both ends that are opened. Thus, the first shell cover 120 may be coupled to one of the both ends of the main shell 110, and the second shell cover 130 may be coupled to the other of the both ends of the main shell 110. Thus, the first shell cover 120 and the second shell cover 130 may be arranged to face away from each other, and the main shell 110 may be formed to seal the inner space of the shell 100 by connecting the first shell cover 120 and the second shell cover 130 with each other.

For example, the first shell cover 120 may be disposed on a side of a refrigerant inlet 210 to be described later, and the second shell cover 130 may be disposed on a side of a refrigerant outlet 260 to be described later. That is, the first shell cover 120 may be disposed to be spaced apart from the refrigerant outlet 260 and face away from the refrigerant outlet 260, and the second shell cover 130 may be disposed to be spaced apart from the refrigerant inlet 210 and face away from the refrigerant inlet 210. Hereinafter, for convenience of description, a case in which the refrigerant inlet 210 is disposed on the first shell cover 120 and the refrigerant outlet 260 is disposed on the second shell cover 130 will be described.

Accordingly, the inner space in which the driving assembly 200 may be disposed may be defined inside the shell 100.

The driving assembly 200 may be disposed inside the shell 100 and spaced apart from an inner circumferential face of the shell 100. To this end, the compressor 10 may include a bracket 20 for fixing the driving assembly 200 in a state spaced apart from the inner circumferential face of the shell 100.

The bracket 20 may be coupled to the driving assembly 200 and the inner circumferential face of the shell 100 to fix the driving assembly 200 in the state spaced apart from the inner circumferential face of the shell 100. That is, the bracket 20 may be disposed between the driving assembly 200 and the inner circumferential face of the shell 100.

The driving assembly 200 includes the refrigerant inlet 210 that guides refrigerant introduced from the outside to the inside of the driving assembly 200.

The refrigerant inlet 210 may include an inlet hole 211 that penetrates the first shell cover 120 to communicate the inside and the outside of the shell 100 with each other, wherein the refrigerant flows into the inlet hole 211, and an inlet guide 213 coupled with an inner face (one face facing the driving assembly) of the first shell cover 120 to guide the refrigerant introduced through the inlet hole 211 to a muffler 220 to be described later.

The inlet hole 211 is defined to be connected to an external component (e.g., an evaporator) of the compressor 10 to receive the refrigerant.

The inlet guide 213 includes one side coupled to the first shell cover 120 and the other side bent and extended toward the second shell cover 130 from the one side, thereby guiding the refrigerant introduced through the inlet hole 211 toward the muffler 220 to be described later.

The driving assembly 200 may include a compression assembly 230 that pressurizes the refrigerant to change a state of the refrigerant into a state of high pressure and high temperature, the muffler 220 that guides the refrigerant introduced through the refrigerant inlet 210 to the compression assembly 230, and the driver 240 that drives the compression assembly 230.

The muffler 220 may include a plurality of resonating portions and a dissipating portion for reducing noise or vibration caused while the refrigerant introduced through the refrigerant inlet 210 flows to the compression assembly 230.

Each of the plurality of resonating portions provides a flow path for the refrigerant, but is formed to have a predetermined volume, so that the vibration or the noise caused by the refrigerant flowing through the flow path may be reduced.

The plurality of resonating portions may include a first resonating portion 221, a second resonating portion 223, a third resonating portion 225, and a fourth resonating portion 227 that are sequentially arranged from the first shell cover 120 to the second shell cover 130. In addition, in order to efficiently reduce the vibration or the noise generated from the refrigerant, the predetermined volumes of the first resonating portion 221, the second resonating portion 223, the third resonating portion 225, and the fourth resonating portion 227 may be different from each other.

A dissipating portion 229 may extend from an outer face of one of the plurality of resonating portions to be in contact with an inner face of a piston 231 to be described later. Accordingly, the vibration or the noise may be reduced by expanding a flow path of the vibration or the noise flowing through the muffler 220. For example, the dissipating portion 229 may extend from the outer face of the fourth resonating portion 227 and be coupled with a cylinder 233 to be described later.

The compression assembly 230 may include the piston 231 configured to receive power from the driver 240 to linearly move, and the cylinder 233 that accommodates the piston 231 therein and provides a space for the piston 231 to move.

The linear motion of the piston 231 may mean a motion in a first direction from the first shell cover 120 to the second shell cover 130, and a motion in a second direction from the second shell cover 130 to the first shell cover 120.

The cylinder 233 may be formed in a shape of a hollow cylinder having one open end. Accordingly, the piston 231 may be inserted into the open end of the cylinder 233 to define a compression chamber P in which the refrigerant is compressed.

The piston 231 may be formed in a shape of a hollow cylinder having one open end. That is, one face of the piston 231 facing the first shell cover 120 is opened to accommodate at least a portion of the muffler 220. Accordingly, the refrigerant that has flowed through the muffler 220 may flow into the piston 231 and then be guided to the compression chamber P. Specifically, a through-hole that guides the refrigerant to the compression chamber P is defined in the other face of the piston 231 to guide the refrigerant that has flowed into the piston 231 to the compression chamber P.

The driver 240 may include a permanent magnet 241 for driving the compression assembly 230 and stators 243 and 245 for forming a magnetic field such that the permanent magnet 241 moves.

The permanent magnet 241 refers to a magnet that preserves a magnetized state. However, in some cases, an electromagnet that is magnetized by an electric current may be used. The permanent magnet 241 may be disposed to be spaced apart from the compression assembly 230.

The stator may include an inner stator 243 disposed between the permanent magnet 241 and the compression assembly 230 and an outer stator 245 spaced apart from the permanent magnet 241 in a direction away from the compression assembly 230.

At least one of the inner stator 243 and the outer stator 245 may form the magnetic field to move the permanent magnet 241. In this connection, a direction in which the permanent magnet 241 moves may be the same as the direction in which the piston 231 moves, but the present disclosure may not be limited thereto.

For example, when the permanent magnet 241 moves linearly, the permanent magnet 241 may be disposed to be in contact with the piston 231 to apply the force to the piston 231. However, when the permanent magnet 241 does not move linearly or does not move in the same manner as the piston 231 even though the permanent magnet 241 moves linearly, the permanent magnet 241 may change the movement direction thereof to be coupled to a separate member that transmits the power to the piston 231, thereby applying the force to the piston 231.

In addition, the driver 240 may include a reciprocating spring 247 whose natural frequency is adjusted such that the piston 231 may reciprocate, and a support 249 connecting the reciprocating spring 247 and the piston 231 with each other.

A plurality of reciprocating springs 247 may be arranged. When the plurality of reciprocating springs are arranged, natural frequencies of the reciprocating springs may be set differently.

One side of the support 249 may be coupled to the reciprocating spring 247 and the other side of the support 249 may be coupled to the piston 231 to transmit an elastic force applied to the reciprocating spring 247 to the piston 231.

The reciprocating spring 247 may be deformed as one end thereof is coupled to the piston 231 and the other end thereof is coupled to a back frame 255 to be described later.

In one example, the muffler 220 may be coupled to the piston 231 to move in response to the movement of the piston 231. As described above, at least one of the plurality of resonating portions may be accommodated in the opening of the piston 231, and the remainder of the plurality of resonating portions may be coupled to the piston 231 to be in communication with the inlet hole 211. Therefore, the refrigerant that has flowed through the inlet hole 211 may flow into the piston 231 through the plurality of resonating portions sequentially arranged in the direction from the first shell cover 120 to the second shell cover 130, and the refrigerant that has flowed into the piston 231 may be guided to the compression chamber P through the other face of the piston 231.

The driving assembly 200 may include a frame 250 disposed to surround at least a portion of the driving assembly 200.

The frame 250 may include a main frame 251 disposed to surround at least a portion of the compression assembly 230, a stator frame 253 disposed to surround at least a portion of the stator, and the back frame 255 disposed to surround at least a portion of the muffler 220.

The main frame 251 may be disposed to surround the cylinder 233 so as to surround at least a portion of the compression chamber P. In addition, the main frame 251 may support the compression assembly 230 and the driver 240 by connecting the compression assembly 230 and the driver 240 with each other. That is, the main frame 251 may be formed closer to the refrigerant outlet 260 than the refrigerant inlet 210.

The stator frame 253 may support one side of one of the inner stator 243 and the outer stator 245. In this case, the other side of one of the inner stator 243 and the outer stator 245 may be supported by the main frame 251.

The back frame 255 may be coupled to the stator frame 253 and extend toward the first shell cover 120, and then may be bent toward the inlet hole 211. In addition, a through-hole may be defined in the back frame 255 to be in communication with the inlet hole 211. As described above, the back frame 255 may be coupled to the reciprocating spring 247 to induce the deformation of the reciprocating spring 247.

The driving assembly 200 may include the refrigerant outlet 260 through which the refrigerant compressed in the compression chamber P is discharged.

The refrigerant outlet 260 may include an outlet valve 261 selectively opened and closed based on a pressure of the refrigerant located in the compression chamber P, a valve spring 263 coupled to the outlet valve 261 to reduce vibration or noise generated from the outlet valve 261, a stopper 265 coupled to the valve spring 263 to prevent excessive deformation of the valve spring 263, an outlet hole 267 through which the refrigerant passed through the outlet valve 261 flows, and a resonance frame 269 that defines the outlet hole 267 and reduces the vibration or the noise caused by the refrigerant.

The outlet valve 261 may be disposed at an end located farthest from the refrigerant inlet 210 of the cylinder 233.

The outlet valve 261 may be provided as an electronic valve that is opened in response to a command of a controller (not shown) when the pressure of the refrigerant located in the compression chamber P is calculated and determined to be equal to or greater than a predetermined pressure, and may be formed as a valve having a structure that automatically opens when the pressure of the refrigerant located in the compression chamber P is calculated to be equal to or greater than a certain pressure.

The valve spring 263 may be provided as a leaf spring to reduce the vibration or the noise generated from the outlet valve 261, and may be coupled to the outlet valve 261 in a direction away from the refrigerant inlet 210.

The stopper 265 may be oriented in a direction of the valve spring 263 away from the refrigerant inlet 210, and may be at least partially in contact with the valve spring 263. In particular, when the valve spring 263 is provided as the leaf spring, the stopper 265 may be formed in a flat plate shape.

The resonance frame 269 may be coupled to the main frame 251 or a discharge cover 270 to be described later, and may protrude in the direction away from the refrigerant inlet 210. In addition, a portion of the resonance frame 269 may be penetrated to define the outlet hole 267 in communication with the compression chamber P.

The driving assembly 200 may include the discharge cover 270 in communication with the refrigerant outlet 260 and accommodating the refrigerant outlet 260 therein.

The discharge cover 270 may be coupled to at least one of the main frame 251 and the resonance frame 269 to surround the refrigerant outlet 260. In addition, the discharge cover 270 may protrude in the direction away from the refrigerant inlet 210 to define a discharge space S therein.

The discharge space S is defined to be in communication with the outlet hole 267 to guide the refrigerant that has flowed through the outlet hole 267 to the outside of the compressor 10.

The discharge cover 270 may include a plurality of covers sequentially arranged along the direction away from the refrigerant inlet 210.

For example, a first discharge cover 271 may be coupled to the resonance frame 269, and a second discharge cover 273 may be coupled to the main frame 251 to surround the first discharge cover 271.

When the discharge cover 270 includes the plurality of covers, the vibration or the noise generated by the flow of the refrigerant may be reduced.

Figure 2:
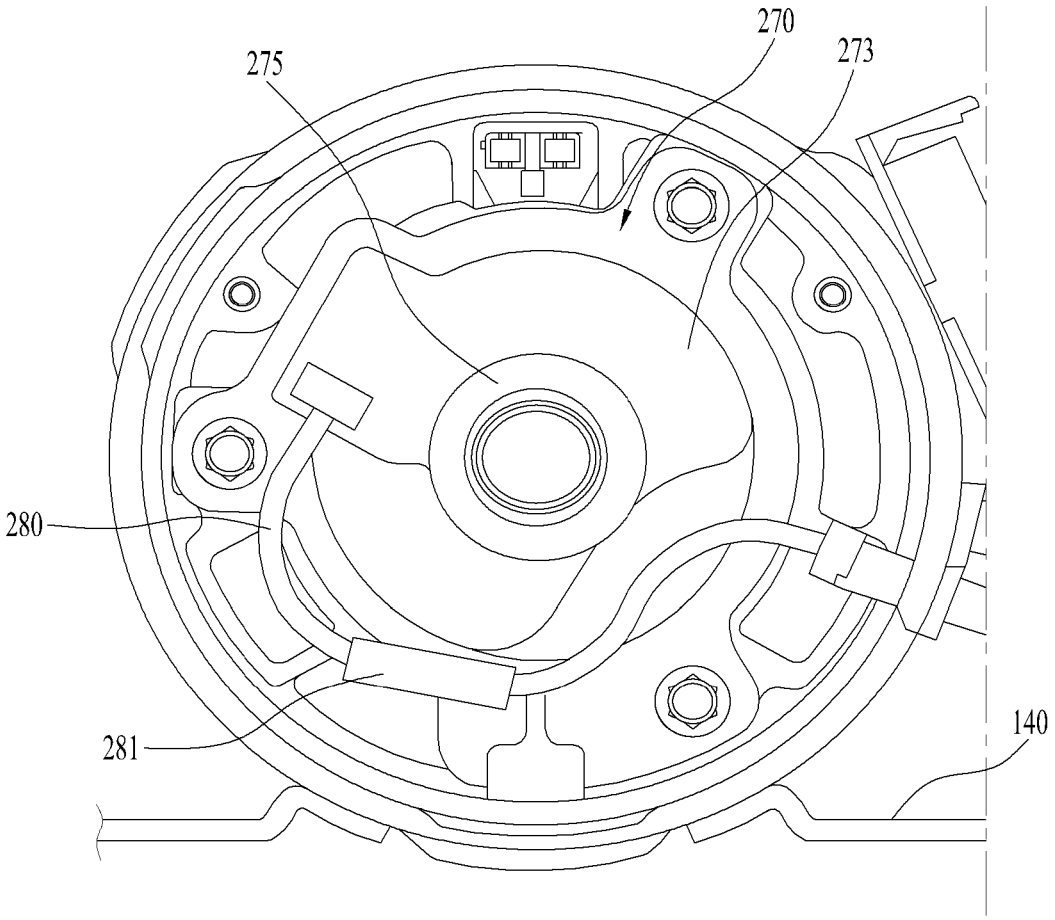
FIG. 2 is a view showing a compressor viewed from a refrigerant outlet side.

The driving assembly 200 may include a discharge hose 280 communicating an inner space of the discharge cover 270 and an outer space of the compressor 10 with each other (see FIG. 2).

The discharge hose 280 may be disposed to pass through the discharge cover 270 to be in communication with the discharge space S. Accordingly, the refrigerant located in the discharge space S may flow through the discharge hose 280 to be discharged to the outside of the compressor 10 (see FIG. 2).

The discharge hose 280 may have a predetermined length to communicate the discharge space S with the outer space of the compressor 10, and may include a vibration absorbing member 281 disposed to surround at least a portion of the discharge hose 280 to reduce the vibration or the noise generated by the refrigerant flowing through the discharge hose 280 (see FIG. 2).

Thus, the refrigerant that has flowed through the refrigerant inlet 210 may flow through the muffler 220 and be guided to the compression assembly 230. The refrigerant compressed in the compression assembly 230 may be guided to the outside of the compressor 10 through the refrigerant outlet 260 and the discharge cover 270 in sequence.

In one example, the refrigerant flowing to the outside of the compressor 10 by passing through the refrigerant outlet 260 and the discharge cover 270 in sequence may cause the vibration or the noise in the compressor 10.

FIG. 2 is a view of the discharge cover 270 before the second shell cover 130 is coupled to the compressor 10.

Specifically, referring to FIG. 2, the refrigerant discharged from the refrigerant outlet 260 to the discharge cover 270 may flow through the discharge hose 280 and be discharged to the outside of the compressor 10. In this connection, as the refrigerant flows inside the discharge cover 270 or flows into the discharge hose 280 from the discharge cover 270, the refrigerant may cause the vibration or the noise.

In addition, even when the driving assembly 200 is fixedly disposed to be spaced apart from the inner circumferential face of the shell 100, the driving assembly 200 may temporarily in contact with the shell 100 based on the operation of the driver 240.

When the driving assembly 200 comes into contact with the shell 100, the vibration or the noise generated from the driving assembly 200 may be transmitted to the shell 100 as it is and exposed to the outside of the compressor 10.

In particular, when the compressor 10 is installed in an electronic device such as a refrigerator and the like, the compressor 10 is sometimes installed lying on a bottom face of the electronic device. In this connection, the case in which the compressor 10 is installed lying may mean a case in which the first shell cover 120 and the second shell cover 130 are installed in a direction perpendicular to the bottom face. Alternatively, the case in which the compressor 10 is installed lying may mean a case in which, when the main shell 110 has a predetermined horizontal dimension between the both open ends thereof, the main shell 110 is installed such that the horizontal dimension of the main shell 110 is defined in a direction parallel to the bottom face.

When the compressor 10 is installed lying on the bottom face of the electronic device as described above, the shell 100 may include a support member 140 disposed to fix the compressor 10 on the bottom face of the electronic device.

The support member 140 may support the compressor 10 by forming a contact face with the bottom face and at the same time forming a contact face with the main shell 120.

In this case, the driving assembly 200 may be disposed inside the shell 100 and receive a load in a direction toward the bottom face. That is, the vibration or the noise generated in the driving assembly 200 may overlap with the load generated in the driving assembly 200 to temporarily contact the driving assembly 200 with the shell 100.

Accordingly, there is a need for a component for reducing the vibration or the noise caused by the refrigerant flowing through the refrigerant outlet 260 and the discharge cover 270 and for preventing the driving assembly 200 from being temporarily biased inside the shell 100.

Figure 3A:
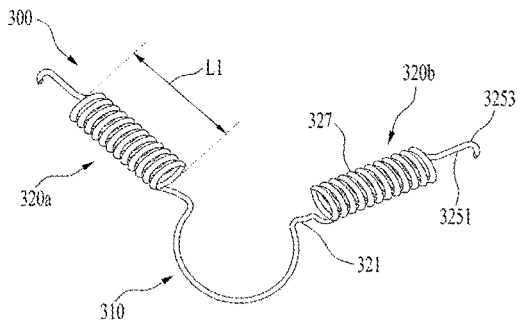
FIGS. 3A and 3B are views showing a vibration attenuating member according to an embodiment of the present disclosure.
Figure 3B:
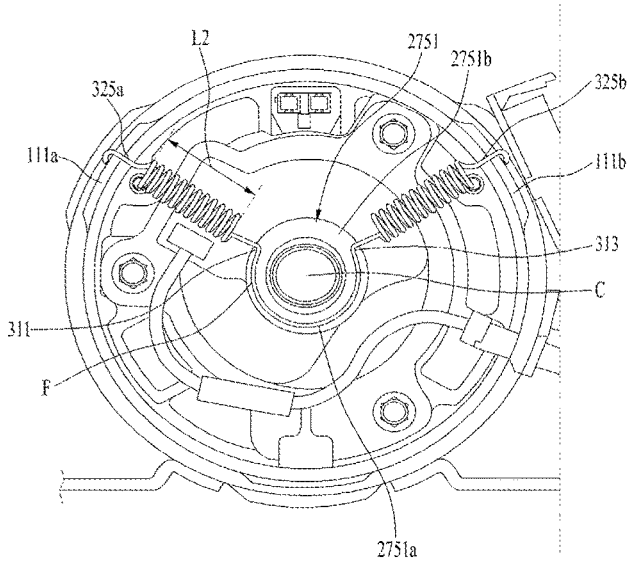

FIGS. 3A and 3B are diagrams illustrating a vibration attenuating member 300 according to an embodiment of the present disclosure.

Referring to FIGS. 3A and 3B, the vibration attenuating member 300 may be disposed between the driving assembly 200 and the shell 100 to reduce the vibration or the noise generated in the driving assembly 200.

The vibration attenuating member 300 may connect the driving assembly 200 and the shell 100 with each other, and may support the driving assembly 200 and the shell 100.

To this end, the vibration attenuating member 300 may include a support portion 310 in contact with the driving assembly 200 to support the driving assembly 200, and an attenuating portion 320 extending from the support portion 310 toward the shell 100 to be coupled to the shell 100.

That is, the support portion 310 may receive the vibration or the noise from the driving assembly 200 and transmit the vibration or the noise to the attenuating portion 320, and the attenuating portion 320 may receive the vibration or the noise from the support portion 310 and attenuate or reduce the vibration or the noise.

Therefore, the attenuating portion 320 preferably has a sufficient length.

To this end, the discharge cover 270 may include a protruding portion 275 formed to protrude from a portion of the discharge cover 270 to have a diameter smaller than a diameter of the discharge cover 270.

The protruding portion 275 may be disposed closer to the second shell cover 130 than the first discharge cover 271 and the second discharge cover 273.

When the second discharge cover 273 is disposed farther from the refrigerant inlet 210 than the first discharge cover 271, the protruding portion 275 may protrude from the second discharge cover 273 in the direction away from the refrigerant inlet 210.

That is, the protruding portion 275 may mean a component disposed at a position of the discharge cover 270 farthest from the refrigerant inlet 210 or the closest to the second shell cover 130.

The protruding portion 275 may protrude from the portion of the discharge cover 270 to contain a center C of the discharge cover 270. In this connection, when forming cross-sections of the inner circumferential face of the shell 100 in a direction perpendicular to the ground, the center C of the discharge cover 270 may mean a virtual line (which may be parallel to the bottom face of the electronic device) connecting centers of the cross-sections with each other.

Accordingly, when the support portion 310 is coupled to the protruding portion 275, the sufficient length of the attenuating portion 320 may be formed.

To attenuate or reduce the vibration or the noise transmitted from the support portion 310, the attenuating portion 320 may include an extension 321 extending from the support portion 310 toward the inner circumferential face of the shell 100, a coupling portion 325 to be coupled to the shell, and a coil 327 for connecting the extension 321 and the coupling portion 325 with each other to reduce the vibration or the noise.

As the coil 327 reduces or attenuates the vibration or the noise, the coil 327 is spaced apart from the support portion 310 and is preferably spaced apart from the shell 100 too.

That is, the extension 321 and the coupling portion 325 are configured to transmit the vibration or the noise to the coil 327, but are able to have predetermined lengths such that the coil 327 is spaced apart from the support portion 310 and the shell 100.

The coil 327 may have at least a turn such that a wire having a predetermined diameter is formed in a spring shape.

The coil 327 may have the at least one turn, and may have a multiple of turns arranged along an extending direction of the attenuating portion 320. Accordingly, the coil 327 may have elasticity, and may provide an elastic force to the shell 100 and the driving assembly 200.

To form a sufficient length of the coil 327, the coupling portion 325 may include a coupling extension portion 3251 extending from the coil 327 toward the shell 100, and a coupling forming portion 3253 extending from the coupling extension portion 3251 to be coupled to the shell 100.

The coupling extension portion 3251 may have a predetermined length to space the shell 100 and the coil 327 apart from each other. In addition, the coupling extension portion 3251 may be disposed to be in contact with the end facing the second shell cover 130 of the ends of the main shell 110. To this end, the main shell 110 may have an incision that is cut such that the coupling extension portion 3251 is in contact with the main shell 110 but does not interfere with the second shell cover 130, and the coupling extension portion 3251 may be in contact with the incision.

The coupling forming portion 3253 is coupled to the shell 100 to form the sufficient length of the coil 327, and may be in contact with an outer circumferential face of the shell 100.

The coupling forming portion 3253 may include a hook bent and extended in a direction toward the support portion 310 to be coupled to the shell 100. To this end, the shell 100 may include a catching hole 111 defined therein such that the coupling forming portion 3253 is fixedly inserted to the catching hole 111. The catching hole 111 may be defined anywhere on the shell 100, but may be preferably formed on the main shell 110. The catching hole 111 may be defined in the main shell 110 for convenience of manufacture and assembly, and for the sufficient length of the attenuating portion 320.

In one example, the coil 327 is preferably disposed between the driving assembly 200 and the shell 100 to apply the elastic force to the driving assembly 200 and the shell 100 even when the driving assembly 200 is not biased or shaken temporarily.

In other words, it is preferable that the length of the coil 327 is increased while being coupled to the driving assembly 200 and the shell 100.

Specifically, FIG. 3A is a view showing a state before the vibration attenuating member 300 is coupled to the driving assembly 200 and the shell 100, and FIG. 3B is a view showing a state in which the vibration attenuating member 300 is coupled to the driving assembly 200 and the shell 100.

The coil 327 may have a first length L1 before the vibration attenuating member 300 is coupled to the compressor 10. In this connection, the length of the coil 327 may mean a predetermined length formed along the extending direction of the attenuating portion 320 from the extension 321 to the coupling portion 325, and may mean a section in which the spring shape of the coil 327 is maintained or the structure in which the multiple of turns of the coil 327 are arranged is maintained along the extending direction of the attenuating portion 320.

In addition, the first length L1 of the coil 327 may mean a length in a state in which an equilibrium of force is maintained because no external force acts on the vibration attenuating member 300.

The coil 327 may have a second length L2 after the vibration attenuating member 300 is coupled to the compressor 10.

It is preferable that the first length L1 is smaller than the second length L2. That is, it is preferable that the coil 327 is changed into an extended state while being coupled to the compressor 10.

This is because it is preferable that the vibration attenuating member 300 applies the elastic force even when the driving assembly 200 does not change a position thereof with respect to the shell 100 in consideration that the coil 327 may apply the elastic force only as much as the coil 327 is deformed, that the driving assembly 200 is temporarily biased inside the shell 100, and that the driving assembly 200 is not biased much.

However, when the coil 327 is extended and coupled to the compressor 10, it is preferable that the attenuating portion 320 includes a plurality of attenuating portions. This is because when one attenuating portion 320 is provided, a direction of the elastic force provided by the attenuating portion 320 to the compressor 10 may be limited.

To this end, the vibration attenuating member 300 may include a first attenuating portion 320*a* extending from one side of the support portion 310 and coupled to the shell 100, and a second attenuating portion 320*b* extending from the other side of the support portion 310 and coupled to the shell 100.

However, the first attenuating portion 320*a* and the second attenuating portion 320*b* differ only in position, and shapes thereof are the same as the above description, and therefore, a duplicate description will be omitted.

It is preferable that the first attenuating portion 320*a* and the second attenuating portion 320*b* extend in different directions from the support portion 310 so as to be spaced apart from each other.

In addition, when the compressor 10 is installed lying on the bottom face of the electronic device, the load of the driving assembly 200 may act inside the shell 100 as described above. Therefore, it is preferable that the support portion 310 surrounds a circumference of a portion of the protruding portion 275.

That is, the support portion 310 may not surround an entire circumference of the protruding portion 275 to support the load of the driving assembly 200, but may include an opened one side and the other side in contact with the protruding portion 275.

In other words, the support portion 310 may include the other side that is in contact with the driving assembly 200 and one side that is not in contact with the driving assembly 200.

In addition, the protruding portion 275 may include a circumferential portion 2751 to which the vibration attenuating member 300 is contacted. Considering that one side of the support portion 310 is open, the circumferential portion 2751 may include a contact portion 2751*a* in contact with the other side of the support portion 310, and a non-contact portion 2751*b* corresponding to one side of the support portion 310 and not in contact with the support portion 310.

The protruding portion 275 may have a groove in the circumferential portion 2751 to be more stably coupled with the support portion 310. Accordingly, the support portion 310 may be seated in the groove defined in the circumferential portion 2751 to support the driving assembly 200.

The contact portion 2751*a* is preferably formed larger than the non-contact portion 2751*b*. That is, it is preferable that a predetermined length formed by the contact portion 2751*a* is greater than a length formed by the non-contact portion 2751*b*.

In addition, a portion of the support portion 310 in contact with the driving assembly 200 may be adjacent to the bottom face of the electronic device, and a portion of the support portion 310 that is not in contact with the driving assembly 200 and thus opened may be disposed so as to be away from the bottom face of the electronic device.

In other words, the portion of the support portion 310 in contact with the driving assembly 200 may be closer to the bottom face of the electronic device than the portion of the support portion 310 that is not in contact with the driving assembly 200.

The support portion 310 may have both ends based on the non-contact portion thereof. That is, the non-contact portion of the support portion 310 may be defined between a first end 311 and a second end 313 of the support portion 310.

The first attenuating portion 320*a* may extend from the first end 311 and be coupled to the shell 100, and the second attenuating portion 320*b* may extend from the second end 313 and be coupled to the shell 100.

The support portion 310 may be extended from the first end 311 to the second end 313, and have a portion F extending in a manner away from both of the first attenuating portion 320*a* and the second attenuating portion 320*b* at the same time.

Alternatively, the support portion 310 may be formed to connect the first end 311 and the second end 313 with each other, and protrude in a direction away from catching holes 111*a* and 111*b* where the attenuating portions 320*a* and 320*b* are coupled to the shell. In this connection, a first catching hole 111*a* means a portion where the first attenuating portion 320*a* is inserted into the shell 100, and a second catching hole 111*b* means a portion where the second attenuating portion 320*b* is inserted into the shell 100.

Alternatively, the support portion 310 may connect the first end 311 and the second end 313 with each other and protrude in a direction away from the first attenuating portion 320*a* and the second attenuating portion 320*b*.

Alternatively, the support portion 310 may be in contact with a lower side of the protruding portion 275 to support the driving assembly 200. In this connection, the term "lower side" may mean a position at which a force opposite to the load may be applied in opposition to the load direction.

Assuming that the first attenuating portion 320*a* and the second attenuating portion 320*b* are located on the same plane, the second attenuating portion 320*b* is preferably spaced from the first attenuating portion 320*a* by an angle equal to or greater than 100 degrees. Most preferably, the first attenuating portion 320*a* and the second attenuating portion 320*b* may be spaced from each other by 120 degrees.

In one example, the support portion 310 and the attenuating portion 320 may be integrally formed. In particular, when the attenuating portion 320 includes the plurality of attenuating portions, the plurality of attenuating portions 320 and the support portion 310 may be integrally formed.

When the vibration attenuating member 300 is integrally formed, the position of the attenuating portion 320 may be varied with respect to the support portion 310. In particular, the extension 321 may be formed such that a position thereof is variable with respect to the driving assembly 200. When the position of the extension 321 is variable with respect to the driving assembly 200, an amount of deformation of the coil 327 may be increased. Further, when the amount of deformation of the coil 327 increases, the vibration attenuating member 300 may exert greater force to the compressor 10 to rapidly resolve the temporary bias of the driving assembly 200.

Thus, the support portion 310 may more stably support the load of the driving assembly 200.

In addition, the vibration attenuating member 300 may exert a force for pulling toward the shell 100 to the driving assembly 200. In particular, even when the driving assembly 200 is not biased temporarily, the vibration attenuating member 300 may exert a tensile force to the driving assembly 200 and the shell 100, so that the driving assembly 200 and the shell 100 may be supported more stably.

In addition, because the vibration attenuating member 300 is already coupled with the compressor 10 in a state in which a predetermined length thereof is changed, the vibration attenuating member 300 may exert a restoring force even when the position of the driving assembly 200 is not temporarily varied with respect to the shell 100.

In particular, even though the vibration attenuating member 300 continuously exerts the driving assembly 200 with the force of pulling toward the shell 100, when the attenuating portion 320 includes the plurality of attenuating portions, the force exerted to the driving assembly 200 may not be biased toward one side, so that the driving assembly 200 may not be biased.

Therefore, the vibration attenuating member 300 exerts a greater force at a location between the driving assembly 200 and the shell 100 to support the driving assembly 200 to be spaced apart from the shell 100. Therefore, because the greater force is applied, the vibration may be reduced even when the vibration occurs in the driving assembly 200.

However, the content described above through FIG. 3B has described the case in which there are two attenuating portions 320, but the present disclosure is not necessarily limited thereto.

Hereinafter, a case in which the vibration attenuating member 300 according to an embodiment of the present disclosure includes different numbers of attenuating portions 320 will be described with reference to FIGS. 4A to 5B.

However, there are only differences in the number and the locations of the attenuating portions 320, and the specific shape of the vibration attenuating member 300 overlaps with the content described above, so that a description thereof will be omitted.

Figure 4A:
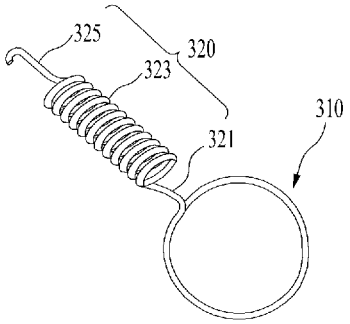
FIGS. 4A and 4B are views showing a vibration attenuating member having different number of attenuating portions according to an embodiment of the present disclosure.
Figure 4B:
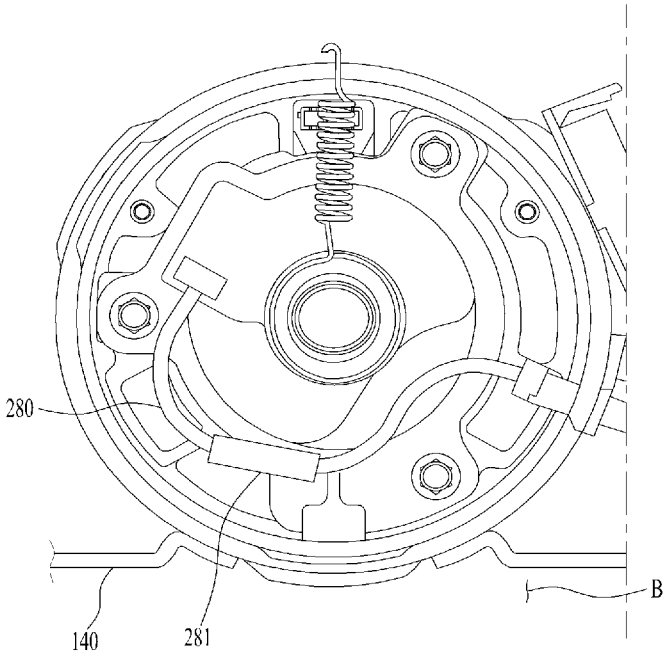

FIGS. 4A and 4B are diagrams illustrating a case in which the vibration attenuating member 300 includes one attenuating portion 320.

Referring to FIGS. 4A and 4B, the vibration attenuating member 300 may include one attenuating portion 320. In this connection, the vibration attenuating member 300 may include the support portion 310 disposed to surround the circumferential portion 2751 of the protruding portion 275.

In this connection, the circumferential portion 2751 of the protruding portion 275 may not include the non-contact portion. That is, the support portion 310 may surround the entire circumference of the protruding portion 275.

In other words, the support portion 310 may be formed in a circle shape, an ellipse shape, or a similar shape forming a closed curve.

This is because it may be difficult to efficiently transmit the vibration or the noise generated in the driving assembly 200 to the attenuating portion 320 when the support portion 310 does not surround the portion of the circumference of the protruding portion 275.

In addition, when the vibration attenuating member 300 includes one attenuating portion 320, it is preferable that the attenuating portion 320 extends from the support portion 310, and extends in a direction perpendicular to the bottom face of the electronic device to be coupled to the shell 100.

As described above, the driving assembly 200 receives the load inside the shell 100. When one attenuating portion 320 is directed in the direction perpendicular to the bottom face, the load of the driving assembly 200 may be more supported.

Preferably, when one coil 327 is extended and coupled to the compressor 10, one attenuating portion 320 may extend in the direction perpendicular to the bottom face from the support portion 310, and extend in a direction away from the bottom face. In this case, a position at which one coupling portion 325 is coupled to the shell 100 may be the highest with respect to the bottom face. That is, one attenuating portion 320 may pull the driving assembly 200 toward the shell 100 in the direction away from the bottom face or in the direction perpendicular to the bottom face.

Figure 5A:
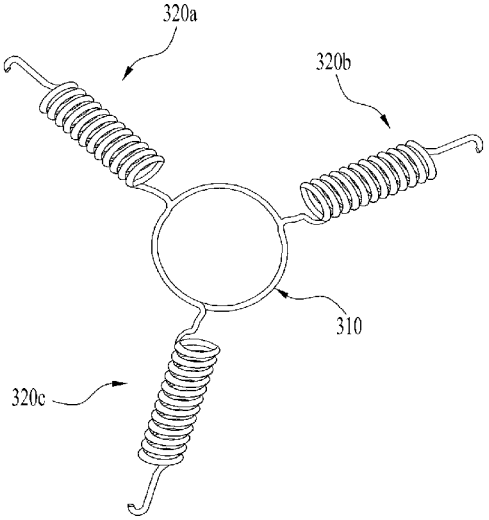
FIGS. 5A and 5B are views showing a vibration attenuating member having different number of attenuating portions according to an embodiment of the present disclosure.
Figure 5B:
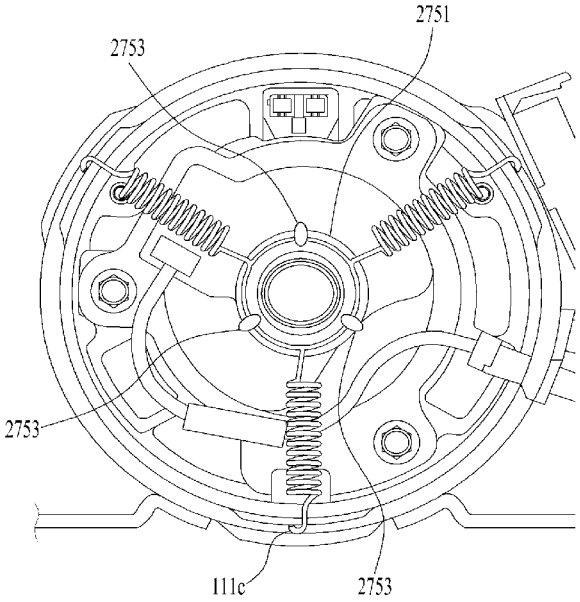

Referring to FIGS. 5A and 5B, the vibration attenuating member 300 may include three attenuating portions.

The vibration attenuating member 300 may include a first attenuating portion 320*a*, a second attenuating portion 320*b*, and a third attenuating portion 320*c* that are extended from the support portion 310 and spaced apart from each other.

In this case, the support portion 310 may be formed in the circle shape, the ellipse shape, or the similar shape forming the closed curve.

However, when three attenuating portions are arranged to support the driving assembly 200, a force exerted by each of the three attenuating portions to the driving assembly 200 may prevent the support portion 310 from being in close contact with the protruding portion 275.

For example, when three attenuating portions are coupled to the protruding portion 275 in an extended state, the support portion 310 may receive a force in a direction spaced apart from the protruding portion 275 from the three attenuating portions.

In this case, the support portion 310 is difficult to come into close contact with the protruding portion 275, so that it may be difficult to receive the vibration or the noise generated from the driving assembly 200 smoothly and transmit the vibration or the noise to the attenuating portion.

Therefore, when the three attenuating portions are arranged, the protruding portion 275 may include close contact members 2753 arranged to contact the support portion 310 to the circumferential portion 2751 closely.

The close contact member 2753 may surround at least a portion of the support portion 310 and be coupled to the protruding portion 275. In addition, the close contact member 2753 may be made of a material having elasticity such that the support portion 310 is in close contact with the circumferential portion 2751. For example, the close contact member 2753 may be made of rubber, plastic, or the like.

The first attenuating portion 320*a*, the second attenuating portion 320*b*, and the third attenuating portion 320*c* may be spaced apart from the support portion 310 and extended, and spaced from each other at equal spacings and extended toward the shell 100.

That is, when it is assumed that the first attenuating portion 320*a*, the second attenuating portion 320*b*, and the third attenuating portion 320*c* are located on the same plane, the first attenuating portion 320*a*, the second attenuating portion 320*b*, and the third attenuating portion 320*c* may be spaced from each other by 120 degrees based on the center C and extended toward the shell 100.

When the first attenuating portion to the third attenuating portion 320*a*, 320*b*, and 320*c* are arranged at the equal intervals, even when the attenuating portion 320 is extended and coupled to the compressor 10, a sum of forces exerted to the driving assembly 200 cancel each other and decrease or may become close to zero.

In particular, when one of the first attenuating portion to the third attenuating portion 320*a*, 320*b*, and 320*c* is extended toward the shell 100 from the support portion 310, but is extended in a direction perpendicular to the bottom face, the vibration attenuating member 300 may support the compressor 10 more stably.

In one example, a diameter or a thickness of the wire formed by the coil 327 (hereinafter, the wire of the attenuating portion is referred to as the attenuating portion) may be formed differently based on a distance spaced apart from the support portion 310.

Figure 6:
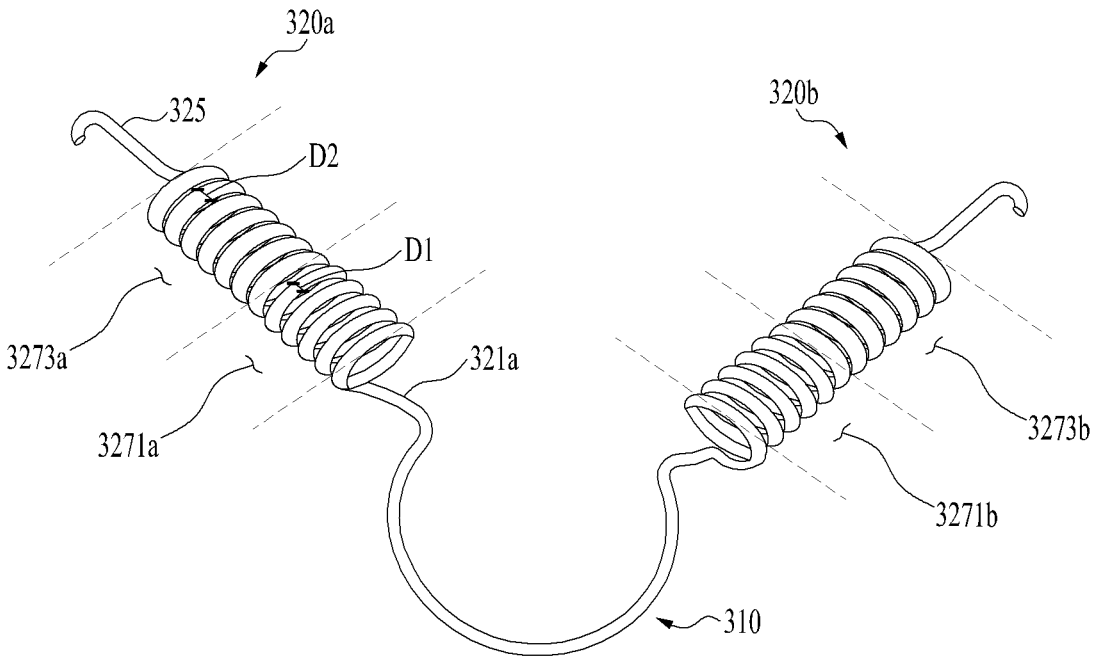
FIG. 6 is a view showing that a shape of an attenuating portion according to an embodiment of the present disclosure is changed.

FIG. 6 is a view showing a state in which a diameter or a thickness of the coil 327 is different.

Referring to FIG. 6, the coil 327 may include an expanding and contracting portion 3271 extending from the extension 321, and a spaced portion 3273 extending from the expanding and contracting portion 3271 toward the shell 100.

The expanding and contracting portion 3271 may be formed closer to the support portion 310 than the spaced portion 3273.

The expanding and contracting portion 3271 may have a first diameter or a first thickness D1, and the spaced portion 3275 may have a second diameter or a second thickness D2.

In this connection, the second diameter or the second thickness D2 is preferably greater than the first diameter or the first thickness D1.

As described above, when the driving assembly 200 comes into contact with the inner circumferential face of the shell 100, the vibration or the noise may be more transmitted to the shell 100 and may be exposed to the outside of the compressor 10.

When the diameter D2 of the spaced portion 3273 is greater than the diameter D1 of the expanding and contracting portion 3271, a range of change of the spaced portion 3273 may be smaller than that of the expanding and contracting portion 3271. That is, considering a case in which the same force acts on the spaced portion 3273 and the expanding and contracting portion 3271, displacement of the expanding and contracting portion 3271 may be greater than that of the spaced portion 3273.

In other words, an elastic modulus of the spaced portion 3273 may be greater than an elastic modulus of the expanding and contracting portion 3271.

When the elastic modulus of the spaced portion 3273 is greater than the elastic modulus of the expanding and contracting portion 3271, the spaced portion 3273 may more block the driving assembly 200 from contacting the inner circumferential face of the shell 100.

In addition, even when the driving assembly 200 temporarily comes into contact with the inner circumferential face of the shell 100, the spaced portion 3273 may exert a greater force to the compressor 10 to quickly separate the driving assembly 200, which is in contact with the inner circumferential face of the shell 100, from the inner circumferential face of the shell 100.

The expanding and contracting portion 3271 and the spaced portion 3273 may have lengths along the extending direction of the coil 327, and the expanding and contracting portion 3271 and the spaced portion 3273 may have different lengths.

When the lengths of the expanding and contracting portion 3271 and the spaced portion 3273 are different from each other, it is preferable that the length of the spaced portion 3273 is smaller than that of the expanding and contracting portion 3271. This is because, considering that the elastic modulus of the expanding and contracting portion 3271 is lower than that of the spaced portion 3273, more changes in the expanding and contracting portion 2371 may be induced than the spaced portion 3273, and the changes in the expanding and contracting portion 2371 may be proportional to an amount of reducing the vibration or the noise generated in the driving assembly 200.

However, alternatively, the length of the expanding and contracting portion 3271 and the length of the spaced portion 3273 may be the same.

In one example, the first attenuating portion 320*a* and the second attenuating portion 320*b* are the same in FIG. 6, but the above description may be applied equally to the first attenuating portion 320*a* and the second attenuating portion 320*b*, so that a detailed description thereof will be omitted.

In one example, the cases in which one or three attenuating portions are arranged will also be the same as described above.

In one example, in order to allow the elastic modulus of the spaced portion 3273 to be greater than the elastic modulus of the expanding and contracting portion 3271, the numbers of multiple arranged turns of wires may be different from each other.

Figure 7:
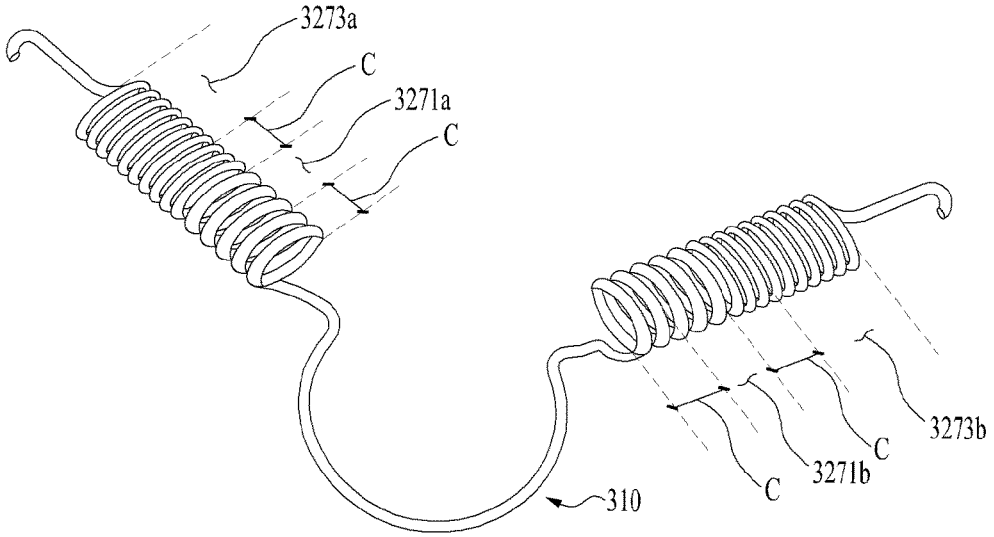
FIG. 7 is a view showing that a shape of an attenuating portion according to an embodiment of the present disclosure is changed.

FIG. 7 is a diagram illustrating a state in which the numbers of multiple arranged turns of wires of the expanding and contracting portion 3271 and the spaced portion 3273 are different from each other.

Referring to FIG. 7, the coil 327 may include the expanding and contracting portion 3271 and the spaced portion 3273 having different numbers or densities of multiple arranged turns of the wires.

In one example, locations or lengths of the expanding and contracting portion 3271 and the spaced portion 3273 are the same as those described above in FIG. 6, so that a duplicate description will be omitted.

As described above, the coil 327 may be composed of the wire and may have multiple of turns arranged along the extending direction of the attenuating portion 320 to be formed in the spring shape. Therefore, the numbers or the densities of the arranged turns of the wires being different means that the wires are formed in the spring shape but have different number of times of bending based on the same length.

More specifically, the expanding and contracting portion 3271 and the spaced portion 3273 may have predetermined lengths along the extending direction of the attenuating portion 320 extending from the support portion 310 toward the shell 100.

Based on a predetermined length C, the number of multiple arranged turns of the expanding and contracting portion 3271 based on the length C may be smaller than the number of multiple arranged turns of the spaced portion 3273 based on the length C.

In other words, a spacing between adjacent turns of the wire of the spaced portion 3273 may be smaller than a spacing between adjacent turns of the wire of the expanding and contracting portion 3271.

Specifically, the turns of the expanding and contracting portion 3271 may be arranged N1 times based on the length C, and the turns of the spaced portion 3273 may be arranged N2 times based on the length C. In this connection, N1 may be smaller than N2.

In one example, the first attenuating portion 320*a* and the second attenuating portion 320*b* are shown in FIG. 7, but specific shapes of coils 327*a* and 327*b* are the same as the above, so that a description thereof will be omitted. In addition, the specific shapes are as described above even when one or three attenuating portions are arranged.

Thus, the spaced portion 3273 has the elastic modulus greater than that of the expanding and contracting portion 3271, so that the shell 100 and the driving assembly 200 may be more quickly spaced apart from each other when the shell 100 and the driving assembly 200 are in contact with each other, and the contact between the shell 100 and the driving assembly 200 may be prevented.

In one example, because the vibration attenuating member 300 supports the compressor 10 by connecting the driving assembly 200 and the shell 100 with each other, the vibration attenuating member 300 includes a portion in contact with the driving assembly 200 or a portion in contact with the shell 100. In addition, vibration or noise may more occur at the contact portions than at other portions.

Figure 8:
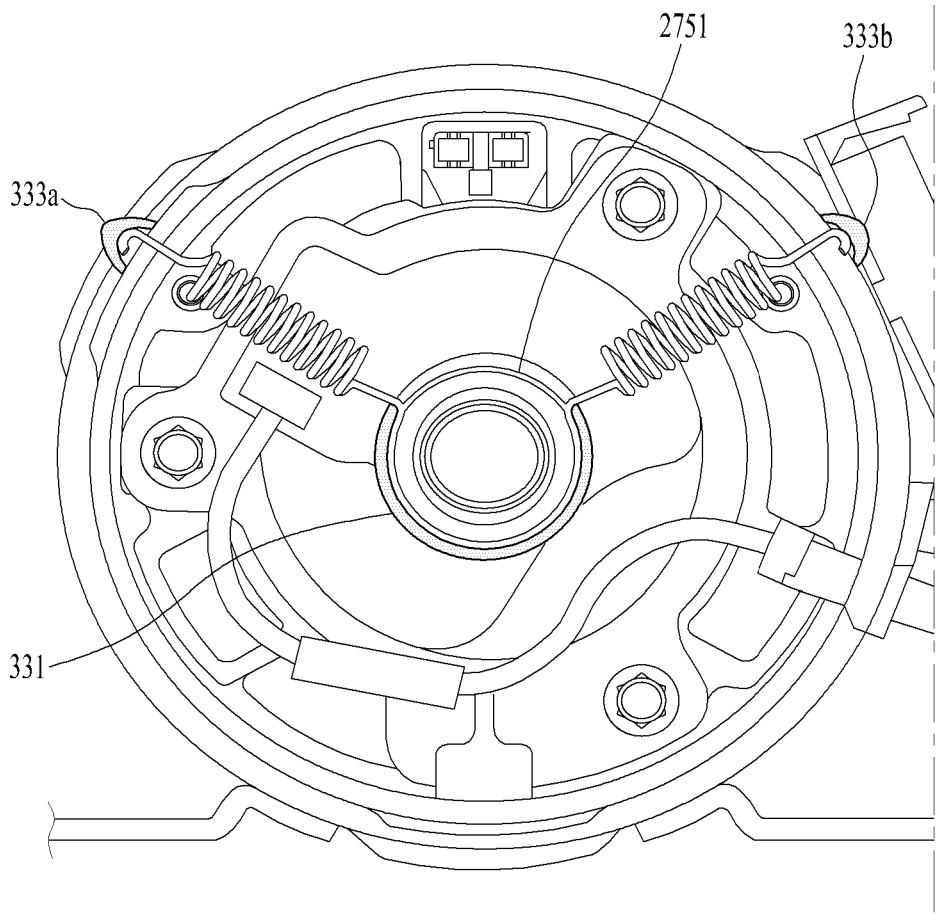
FIG. 8 is a view showing an attenuating member according to an embodiment of the present disclosure.

FIG. 8 is a view showing an attenuating member 330 for the above-described contact portion.

Referring to FIG. 8, the vibration attenuating member 300 may include the attenuating member 330 coupled to the portion where the vibration attenuating member 300 is in contact with the compressor 10 to attenuate or reduce the vibration or the noise.

The attenuating member 330 may include a first attenuating member 331 coupled to the support portion 310, and second attenuating members 333*a* and 333*b* that are coupled to the coupling portion 325.

The first attenuating member 331 may surround the support portion 310 and be coupled to the protruding portion 275.

However, it is preferable that the first attenuating member 331 surrounds an outer face of the support portion 310. This is because contact between the support portion 310 with the driving assembly 200, the discharge cover 270, or the protruding portion 275 must be ensured.

Accordingly, the first attenuating member 331 may be coupled to the support portion 310 to surround the support portion 310 in a direction away from the protruding portion 275.

The second attenuating member 333*a* and 333*b* may cover the outer face of the shell 100, or may be inserted into the catching hole 111.

As described above, when the coupling portion 325 includes the hook, in consideration that the vibration or the noise may be concentrated at the hook, the second attenuating member 333*a* and 333*b* may be coupled to the outer face of the shell 100 to surround the hook.

The attenuating member 330 may contain a material such as sponge or synthetic fiber, and may contain a material such as wood fiber. Alternatively, the attenuating member 330 may contain a urethane material, and may contain a material of rubber or plastic.

In one example, FIG. 8 shows the two attenuating portions 320*a* and 320*b*, but the second attenuating member 333*a* and 333*b* may be coupled to each of the catching holes 111*a* and 111*b* or the coupling portions 325*a* and 325*b*.

Therefore, the vibration attenuating member 300 may reduce the vibration or the noise generated in the driving assembly 200 and transmit the reduced vibration or noise to the shell 100, and may reduce an amount of the vibration or the noise generated in the driving assembly 200.

In addition, the vibration attenuating member 300 may prevent the driving assembly 200 from being temporarily biased inside the shell 100. In particular, the vibration attenuating member 300 may effectively reduce the vibration or the noise caused by the refrigerant flowing through the discharge cover 270 after passing through the refrigerant outlet 260.

Although representative embodiments of the present disclosure have been described in detail above, those of ordinary skill in the technical field to which the present disclosure belongs will understand that various modifications are possible with respect to the above-described embodiments without departing from the scope of the present disclosure. Therefore, the scope of the present disclosure should not be determined being limited to the described embodiment, and should be determined by not only the claims to be described later, but also by those equivalents to the claims.

What is claimed is:

1. A compressor comprising: a shell that defines an exterior appearance of the compressor; a driving assembly disposed inside the shell and spaced apart from an inner circumferential surface of the shell, the driving assembly being configured to compress refrigerant and comprising a discharge cover configured to discharge the refrigerant; and a vibration attenuating member that connects the driving assembly and the shell with each other and is configured to attenuate vibration of the driving assembly, wherein the vibration attenuating member comprises: a support portion that is in contact with the discharge cover and configured to receive the vibration of the driving assembly, the support portion having a first end and a second end and extending from the first end to the second end, and an attenuating portion that extends from the support portion and is coupled to the shell, the attenuating portion being configured to apply a force for pulling the support portion toward the shell and to attenuate the vibration transmitted from the driving assembly to the shell, wherein the attenuating portion comprises (i) a first attenuating portion that extends from the first end of the support portion and (ii) a second attenuating portion that extends from the second end of the support portion, wherein each of the first attenuating portion and the second attenuating portion comprises: an extension that extends from the support portion, a coupling portion that is in contact with the shell and coupled to the shell, and a coil that is disposed between the extension and the coupling portion and connects the extension to the coupling portion, and wherein the support portion protrudes away from the first attenuating portion and the second attenuating portion and surrounds an opposite side of the discharge cover that is disposed away from the first attenuating portion and the second attenuating portion with respect to the discharge cover.

2. The compressor of claim 1, wherein the attenuating portion is configured to, based on deformation of the coil, vary a position of the extension with respect to the driving assembly.

3. The compressor of claim 1, wherein the coil is spaced apart from the shell.

4. The compressor of claim 1, wherein the coil is spaced apart from the driving assembly.

5. The compressor of claim 1, wherein the driving assembly comprises:

a compression assembly including a cylinder and a piston, the piston being configured to compress the refrigerant in the cylinder, and wherein the discharge cover is configured to discharge the refrigerant compressed in the cylinder.

6. The compressor of claim 1, wherein the discharge cover comprises:

a contact portion that is in contact with the support portion; and a non-contact portion that is not in contact with the support portion, and wherein a circumferential length of the contact portion is greater than a circumferential length of the non-contact portion.

7. The compressor of claim 6, wherein the discharge cover comprises a protruding portion that is supported by the support portion, the protruding portion defining a circumferential surface including the contact portion and the non-contact portion.

8. The compressor of claim 1, wherein the coil comprises a plurality of turns arranged along an extending direction of the attenuating portion and configured to apply an elastic force to the shell and the driving assembly.

9. The compressor of claim 8, wherein the shell defines a catching hole, and wherein the coupling portion is inserted into the catching hole and in contact with an outer circumferential surface of the shell.

10. The compressor of claim 9, wherein the coil has a first length in the extending direction, the first length being defined before the coil is inserted into the catching hole, and wherein the coil is configured to, based on the coil being inserted into the catching hole, have a second length that is different from the first length in the extending direction.

11. The compressor of claim 10, wherein the first length is less than the second length.

12. The compressor of claim 11, further comprising a bracket that is disposed between the driving assembly and the inner circumferential surface of the shell and that supports the shell and the driving assembly spaced apart from the inner circumferential surface of the shell.

13. The compressor of claim 9, wherein the vibration attenuating member further comprises an attenuating member disposed between the coupling portion and the catching hole and configured to attenuate vibration transmitted to the coupling portion.

14. The compressor of claim 13, wherein the attenuating member is made of a sponge, a synthetic fiber, rubber, a wood fiber, a urethane material, or a plastic material.

15. The compressor of claim 1, wherein the extension, the coupling portion, and the coil are integrally formed.

16. The compressor of claim 1, wherein the driving assembly comprises:

a cylinder configured to receive the refrigerant;

a piston configured to compress the refrigerant in the cylinder; and the discharge cover, the discharge cover being coupled to the cylinder and configured to discharge the refrigerant compressed in the cylinder.

17. The compressor of claim 16, wherein the support portion has a curved shape extending along the discharge cover.

18. The compressor of claim 1, wherein the first attenuating portion and the second attenuating portion are disposed at a first side with respect to a center of the discharge cover, and wherein the opposite side of the discharge cover surrounded by the support portion is disposed at a second side opposite to the first side with respect to the center of the discharge cover.

19. The compressor of claim 18, wherein the extension, the coil, and the coupling portion are disposed at the first side with respect to the center of the discharge cover.

* * * * *